US010156384B2

(12) United States Patent
Ignatiev

(10) Patent No.: US 10,156,384 B2
(45) Date of Patent: Dec. 18, 2018

(54) HEAT PUMP SYSTEM

(71) Applicant: Emerson Climate Technologies, Inc., Sidney, OH (US)

(72) Inventor: Kirill Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 786 days.

(21) Appl. No.: 14/527,963

(22) Filed: Oct. 30, 2014

(65) Prior Publication Data

US 2015/0114031 A1 Apr. 30, 2015

Related U.S. Application Data

(60) Provisional application No. 61/898,184, filed on Oct. 31, 2013.

(51) Int. Cl.

| | |
|---|---|
| ***F25B 1/00*** | (2006.01) |
| ***F25B 41/04*** | (2006.01) |
| ***F25B 6/04*** | (2006.01) |
| ***F25B 25/00*** | (2006.01) |
| ***F25B 31/00*** | (2006.01) |
| ***F04C 23/00*** | (2006.01) |

(Continued)

(52) U.S. Cl.

CPC ..... *F25B 1/005* (2013.01); *F04C 18/0215* (2013.01); *F04C 23/008* (2013.01); *F04C 29/12* (2013.01); *F25B 6/04* (2013.01); *F25B 25/005* (2013.01); *F25B 31/004* (2013.01); *F25B 41/043* (2013.01); *F25B 2400/05* (2013.01)

(58) Field of Classification Search

CPC ..... F25B 1/005; F25B 6/04; F25B 25/005; F25B 31/004; F25B 41/043; F25B 2400/05; F25B 31/002; F25B 31/006; F04C 18/0215; F04C 23/008; F04C 29/12

USPC ..... 62/505

See application file for complete search history.

(56) References Cited

U.S. PATENT DOCUMENTS

| | | | |
|---|---|---|---|
| 4,818,195 | A | 4/1989 | Murayama et al. |
| 5,636,528 | A | 6/1997 | Sasaki |
| 7,647,790 | B2 | 1/2010 | Ignatiev et al. |

(Continued)

FOREIGN PATENT DOCUMENTS

| | | | |
|---|---|---|---|
| CN | 101398235 | A | 4/2009 |
| CN | 202339048 | U | 7/2012 |

(Continued)

OTHER PUBLICATIONS

Search Report regarding European Patent Application No. 14858897.3, dated Jun. 19, 2017.

(Continued)

*Primary Examiner* — Cassey D Bauer

(74) *Attorney, Agent, or Firm* — Harness, Dickey & Pierce, P.L.C.

(57) ABSTRACT

A climate control system is provided and may include a compressor, a first heat exchanger, a second heat exchanger, and a coolant flow path. The compressor may include a suction port, a first discharge port and a second discharge port. The first heat exchanger may be in fluid communication with the first discharge port. The second heat exchanger may be in fluid communication with the second discharge port. The coolant flow path may be in fluid communication with the first heat exchanger and the second heat exchanger.

17 Claims, 4 Drawing Sheets

(51) Int. Cl.
*F04C 29/12* (2006.01)
*F04C 18/02* (2006.01)

(56) References Cited

U.S. PATENT DOCUMENTS

| | | | | |
|---|---|---|---|---|
| 8,424,337 | B2 | 4/2013 | Scarcella et al. | |
| 2007/0186581 | A1* | 8/2007 | Mistry | F04B 39/06 62/505 |
| 2010/0031677 | A1* | 2/2010 | Lifson | F25B 9/008 62/113 |
| 2010/0307173 | A1 | 12/2010 | Guo et al. | |
| 2012/0125040 | A1* | 5/2012 | Matsui | B01D 39/06 62/470 |
| 2013/0098102 | A1* | 4/2013 | Nakayama | F25B 1/10 62/510 |
| 2013/0247599 | A1 | 9/2013 | Love et al. | |

FOREIGN PATENT DOCUMENTS

| | | | |
|---|---|---|---|
| CN | 202973654 | U | 6/2013 |
| CN | 202993636 | U | 6/2013 |
| DE | 10114160 | A1 | 10/2002 |
| JP | 2004108616 | A | 4/2004 |
| JP | 2006132427 | A | 5/2006 |

OTHER PUBLICATIONS

Office Action regarding Chinese Patent Application No. 201480059872.3, dated Apr. 27, 2017. Translation provided by Unitalen Attorneys at Law.

Second Office Action corresponding to Chinese Application No. 201480059872.3 dated Mar. 5, 2018.

Office Action regarding European Patent Application No. 14858897.3, dated Nov. 22, 2017.

2nd Office Action regarding European Patent Application No. 14858897.3, dated May 17, 2018.

International Search Report regarding Application No. PCT/US2014/063142, dated Feb. 16, 2015.

Written Opinion of the International Searching Authority regarding Application No. PCT/US2014/063142, dated Feb. 16, 2015.

* cited by examiner

HEAT PUMP SYSTEM

CROSS-REFERENCE TO RELATED APPLICATIONS

This application claims the benefit of U.S. Provisional Application No. 61/898,184, filed on Oct. 31, 2013. The entire disclosure of the above application is incorporated herein by reference.

FIELD

The present disclosure relates to a heat pump system and more particularly to a heat pump system having a flow path for heating a fluid.

BACKGROUND

This section provides background information related to the present disclosure which is not necessarily prior art.

Heating and/or cooling systems, including condensing units, heat-pump systems, and other climate control systems may include a compressor, a heat exchanger, a coolant flow path and a lubricant flow path. The coolant flow path and the lubricant flow path may be connected to the heat exchanger and the compressor, such that heat can be transferred from the coolant and/or the lubricant to the environment, or vice versa. It may be desirable to improve the heat transfer characteristics between the coolant and/or the lubricant and the environment.

SUMMARY

This section provides a general summary of the disclosure, and is not a comprehensive disclosure of its full scope or all of its features.

A climate control system constructed in accordance with one example of the present disclosure can include a compressor, a first heat exchanger, a second heat exchanger, and a coolant flow path. The compressor may include a suction port, a first discharge port and a second discharge port. The first heat exchanger may be in fluid communication with the first discharge port. The second heat exchanger may be in fluid communication with the second discharge port. The coolant flow path may be in fluid communication with the first heat exchanger and the second heat exchanger.

A climate control system constructed in accordance with another example of the present disclosure can include a first fluid flow path, a second fluid flow path, and a third fluid flow path. The first fluid flow path may be fluidly coupled to a first heat exchanger, a second heat exchanger and a third heat exchanger. The second fluid flow path may be fluidly coupled to a fourth heat exchanger. The third fluid flow path may be fluidly coupled to the first heat exchanger, the second heat exchanger and the fourth heat exchanger.

A climate control system constructed in accordance with yet another example of the present disclosure can include a compressor, a first heat exchanger, a second heat exchanger, a third heat exchanger, a fourth heat exchanger, a coolant flow path, and a fluid flow path. The compressor may include a suction port, a first discharge port and a second discharge port. The first heat exchanger may be in fluid communication with the first discharge port. The third heat exchanger may be in fluid communication with the second heat exchanger and the suction port. The fourth heat exchanger may be in fluid communication with the second discharge port. The coolant flow path may include the first heat exchanger, the second heat exchanger and the fourth heat exchanger. The fluid flow path may include a fluid source, a fifth heat exchanger, and a fluid reservoir. A fluid may flow from the fluid source to the fifth heat exchanger and from the fifth heat exchanger to the fluid reservoir.

A method of operating a climate control system may include circulating refrigerant through a compressor, a first heat exchanger, a second heat exchanger and a third heat exchanger. The method may also include circulating lubricant through the compressor and a fourth heat exchanger. The method may further include circulating coolant through the first heat exchanger, the second heat exchanger and the fourth heat exchanger.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
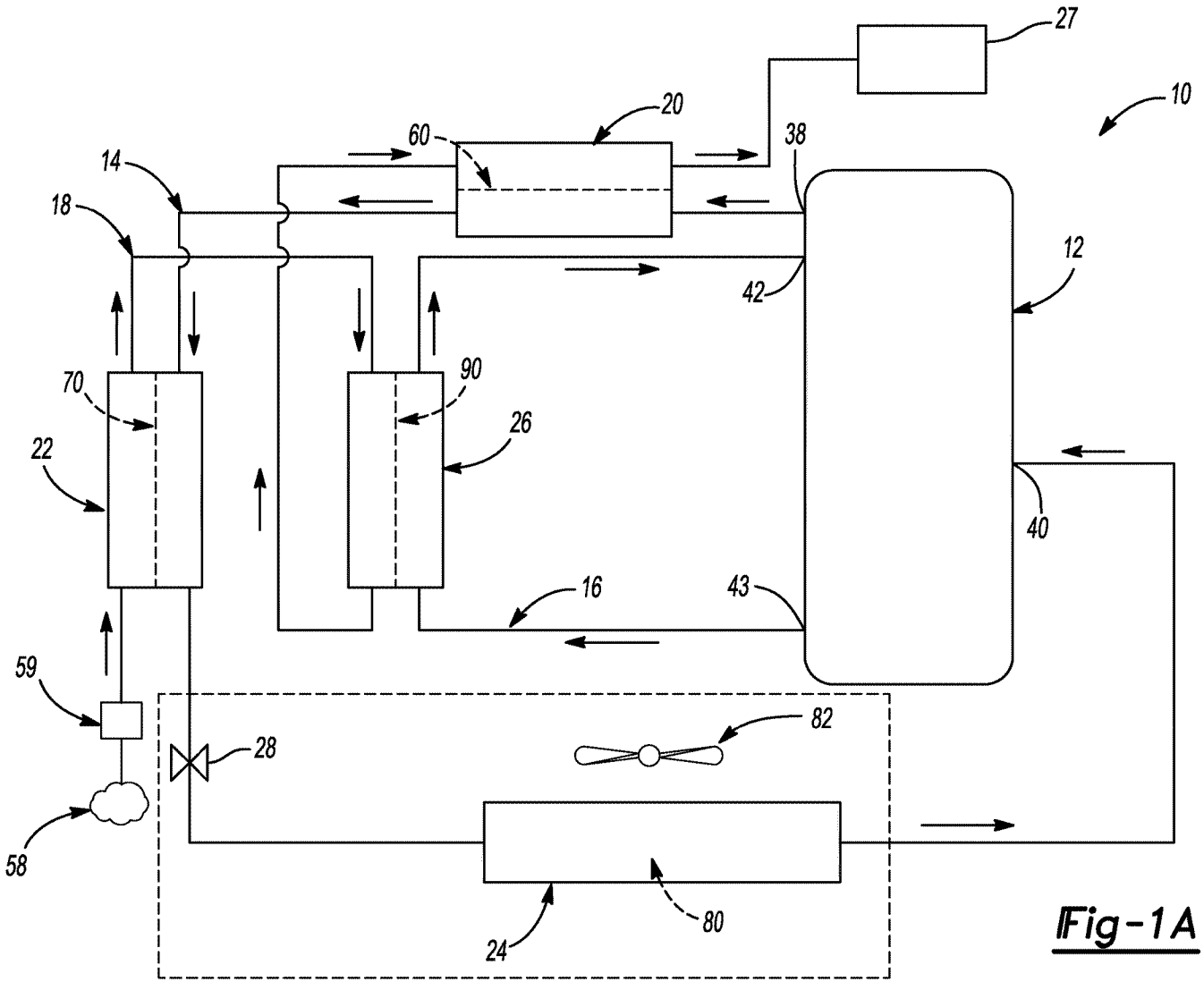
FIG. 1A is a schematic representation of a heat pump system incorporating a water heating system in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1A, a climate control system 10 is provided and may include a compressor 12, a refrigerant flow path 14, a lubricant flow path 16, a coolant flow path 18, a heat exchanger or condenser 20, a heat exchanger or second condenser 22, a heat exchanger or evaporator 24, a lubricant heat exchanger 26, and a fluid reservoir 27. While the first condenser 20, the second condenser 22, the evaporator 24, and the lubricant heat exchanger 26 are described herein as being separate, discrete heat exchangers, it will be appreciated that the first condenser, the second condenser, the evaporator, and the lubricant heat exchanger may be combined into a single heat exchanger unit or assembly or combined into two or three heat exchanger units or assemblies within the scope of the present teachings. By way of example only, the condenser 20 may be combined with the second condenser 22 into a single assembly that includes the first condenser and the second condenser. Likewise, the second condenser 22 may be combined with the lubricant heat exchanger 26 into a single assembly including the second condensor and the lubricant heat exchanger. The fluid reservoir 27 may be a tank such as a hot water heating tank suitable for supplying potable water.

Figure 2:
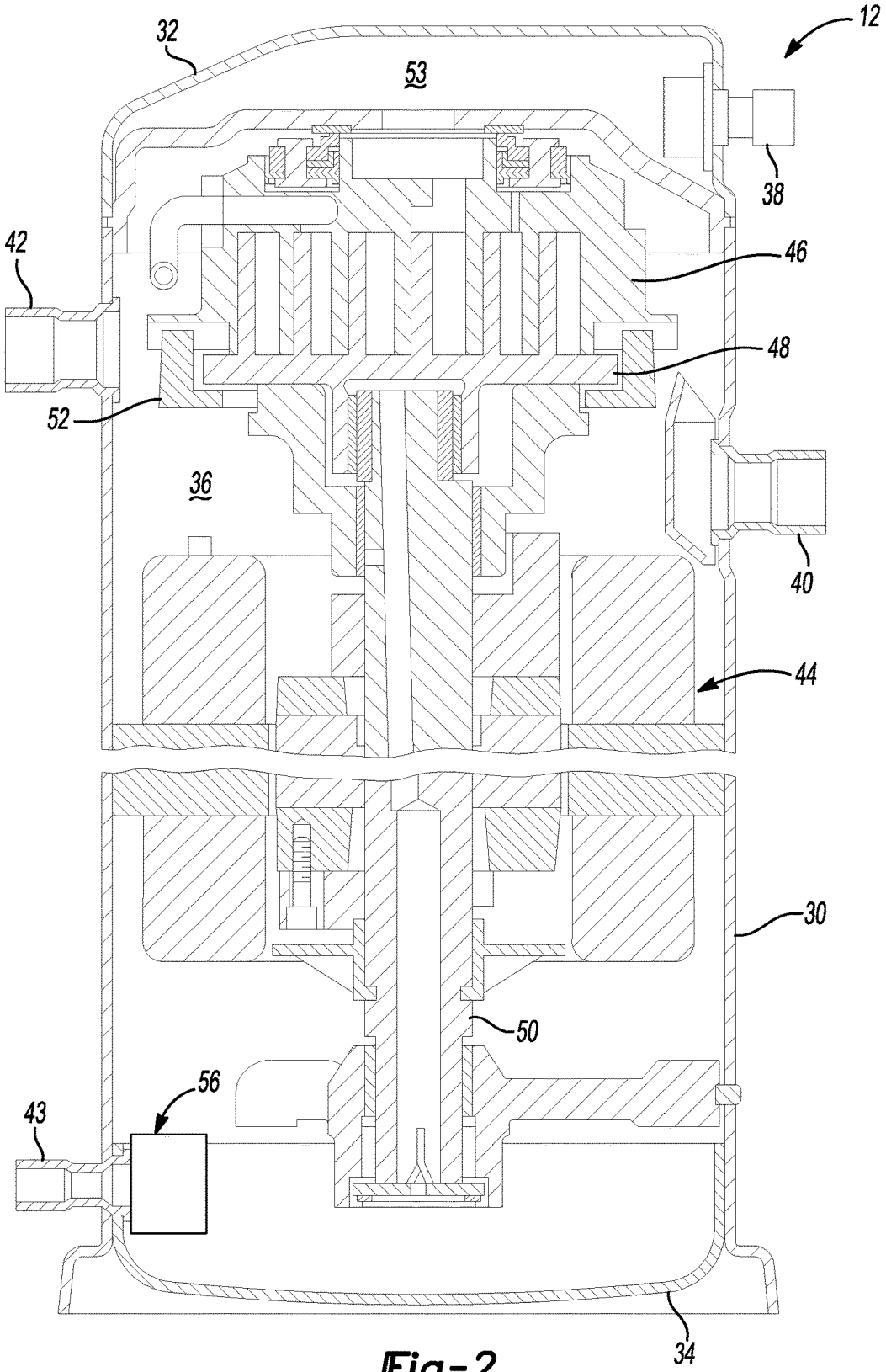
FIG. 2 is a cross-sectional view of a compressor according to the principles of the present disclosure.

With reference to FIG. 2, the compressor 12 may include a generally cylindrical hermetic shell 30 having a cap 32 at a top portion and a base 34 at a bottom portion. The cap 32 and base 34 are fitted to the shell 30 such that an interior volume 36 of the compressor 12 is defined. The cap 32 may include a discharge port 38 while the shell 30 may include a suction port 40, an entry or inlet port 42, and a discharge or outlet port 43. The inlet port 42 may be a lubricant entry port. The outlet port 43 may be a lubricant discharge port.

The compressor 12 also includes a motor 44 mounted to the shell 30 that causes relative orbital motion between two meshingly engaged scroll members 46, 48 via a crankshaft 50 and an Oldham coupling 52. The Oldham coupling 52 and its interaction with scroll members 46, 48 may be of the type disclosed in Assignee's commonly owned U.S. Pat. No. 5,320,506, the disclosure of which is hereby incorporated by reference.

Relative orbital motion between the scroll members 46, 48 draws refrigerant through the suction port 40 and subsequently compresses the refrigerant in at least one moving fluid pocket defined by the scroll members 46, 48. The refrigerant is compressed by the interleaving scroll members 46, 48 as the fluid pockets move from a radially outer position to a central position relative to the scroll members 46, 48, where the compressed refrigerant is exhausted to a discharge chamber 53. The compressed refrigerant is then discharged through the discharge port 38, where it subsequently flows through a discharge line and into the condenser 20.

The refrigerant flow path 14 may include an expansion valve 28. The refrigerant flow path 14 may allow for fluid communication between the suction port 40, the discharge port 38, the condenser 20, the second condenser 22, and the evaporator 24. The expansion valve 28 may be located between the second condenser 22 and the evaporator 24 to control the flow and state of refrigerant (e.g., carbon dioxide, or any other suitable fluid) in the refrigerant flow path 14, and specifically the flow and state (liquid state, gaseous state, or transcritical fluid state) of refrigerant between the second condenser 22 and the evaporator 24.

The lubricant flow path 16 may allow for fluid communication between the inlet port 42, the outlet port 43, and the lubricant heat exchanger 26. Lubricant (e.g., polyester oil, or any other suitable lubricant) may be pumped through the lubricant flow path 16 via a pump 56 disposed within the flow path 16 or within the compressor 12.

The coolant flow path 18 may allow for fluid communication between a coolant source 58, the condenser 20, the second condenser 22, and the lubricant heat exchanger 26. Coolant, such as water, may be pumped from the coolant source 58 and through the coolant flow path 18 via a pump 59.

In one configuration, the condenser 20 may include a first coil or heat exchanger 60. In another configuration, the condenser 20 may be a gas cooler (e.g., if the condenser 20 is being used in a transcritical carbon dioxide system). High-pressure refrigerant in the refrigerant flow path 14 may flow from the compressor 12 into the coil 60 in a first direction. Coolant in the coolant flow path 18 may flow into the condenser 20 from the lubricant heat exchanger 26 in a second direction counterflow to the first direction. Heat may be transferred from refrigerant through the coil 60 and absorbed by the coolant. The condenser 20 may include a protective housing that encases the coil 60 and the coolant in such a manner that coolant may flow across and around the coil 60 to improve heat transfer and rejection of heat. In this regard, it will be understood that the first condenser 20, the second condenser 22, the evaporator 24, and the lubricant heat exchanger 26 may be a shell and tube heat exchanger, a plate heat exchanger, or any other suitable heat exchanger construct.

The second condenser 22 may include a second coil or heat exchanger 70. High-pressure refrigerant in the refrigerant flow path 14 may flow from the condenser 20 into the coil 70 in a first direction. Coolant in the coolant flow path 18 may flow into the second condenser 22 from the coolant source in a second direction counterflow to the first direction. Heat may be transferred from the refrigerant through the coil 70 and absorbed by the coolant. The second condenser 22 may include a protective housing that encases the coil 70 and the coolant in such a manner that coolant may flow across and around the coil 70 to improve heat transfer and rejection of heat.

The evaporator 24 may include a third coil or heat exchanger 80 and a motor-driven fan 82. High-pressure refrigerant in the refrigerant flow path 14 may flow from the second condenser 22 into the coil 80. The coil 80 and the fan 82 may be enclosed in a cabinet so that the fan 82 forces ambient air across the coil 80. The refrigerant passing through the coil 80 absorbs heat from the air being forced across the coil 80 by the fan 82, thereby cooling the air. The fan 82 subsequently forces the cooled air out of the cabinet and into a space to be cooled by the system 10, such as a room, a refrigerator, or a refrigerated display case, for example. Accordingly, it will be understood that the evaporator 24, the expansion valve 28, and the fan 82 may be placed in an interior location.

The lubricant heat exchanger 26 may include a fourth coil or heat exchanger 90. Lubricant in the lubricant flow path 16 may flow from the compressor 12 into the coil 90 in a first direction. Coolant in the coolant flow path 18 may flow into the lubricant heat exchanger 26 from the second condenser 22 in a second direction counterflow to the first direction. Heat may be transferred from refrigerant through the coil 90 and absorbed by the coolant. The lubricant heat exchanger 26 may include a protective housing that encases the coil 90 and the coolant in such a manner that coolant may flow across and around the coil 70 to improve heat transfer and rejection of heat.

Figure 1B:
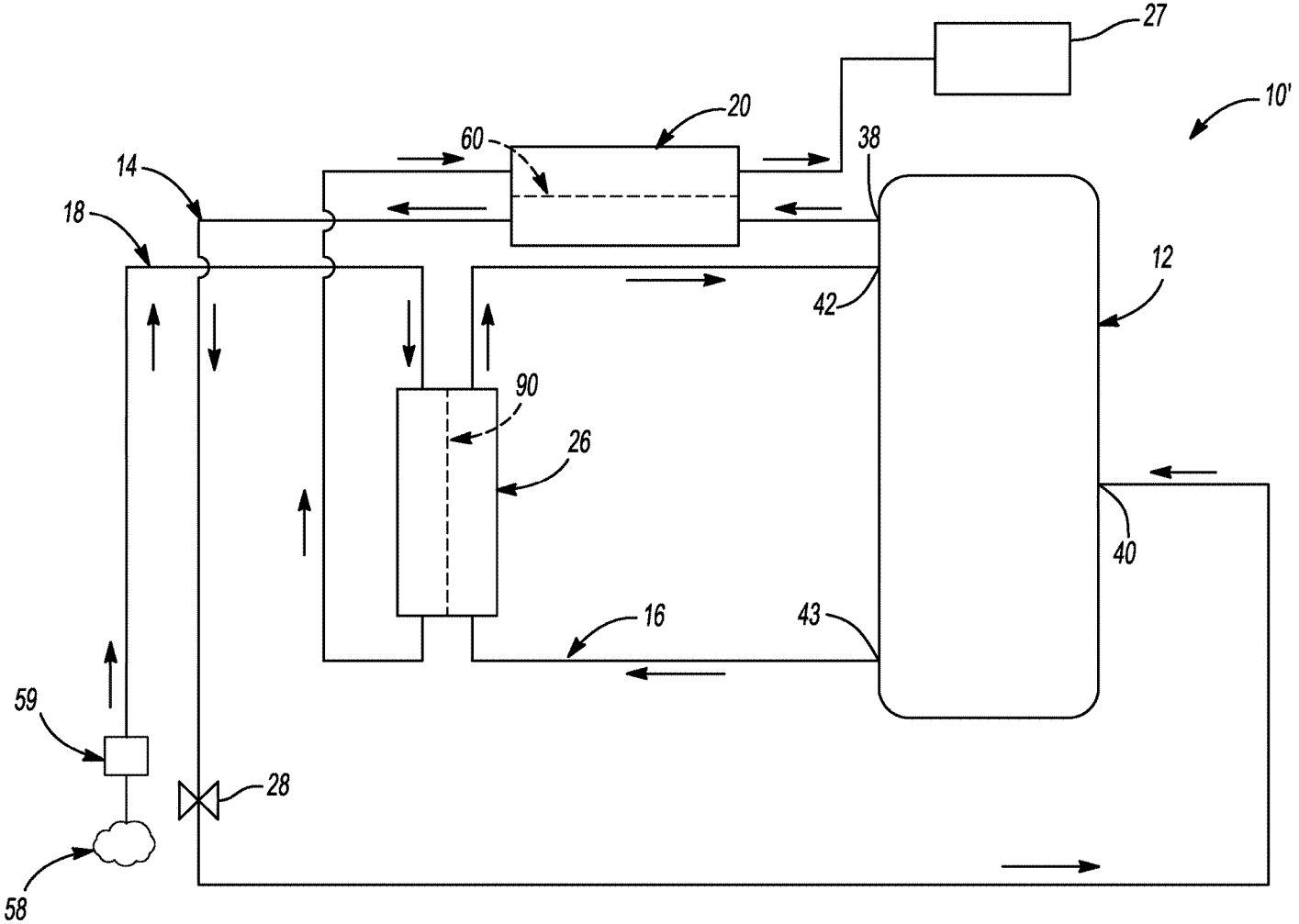
FIG. 1B is a schematic representation of another heat pump system incorporating a water heating system in accordance with the principles of the present disclosure.

With reference to FIG. 1B, in another configuration, a climate control system 10' includes the condenser 20 and the lubricant heat exchanger 26. The climate control system 10' may be substantially similar to the climate control system 10, except as otherwise provided herein. Accordingly, like reference numerals will be used to describe similar features. In the climate control system 10', coolant in the coolant flow path 18 may flow into the lubricant heat exchanger 26 from the coolant source 58 in the second direction counterflow to the first direction. In addition, refrigerant in the refrigerant flow path 14 may flow into the compressor 12 from the condenser 20. The climate control system 10' may optionally include the evaporator 24 located in the refrigerant flow path 14 between the condenser 20 and the compressor 12.

With reference to the figures, operation of the climate control system 10 will be described in detail. As described above, refrigerant may circulate through the refrigerant flow path 14 of the climate control system 10 under pressure from the compressor 12. High pressure refrigerant may leave the discharge port 38 and circulate (i) from the condenser 20 to the second condenser 22, (ii) through the expansion valve 28, and (iii) into the evaporator 24. As the refrigerant passes through the evaporator 24, it may undergo a phase transformation from a liquid to a gaseous state as it absorbs heat from the air being forced across the evaporator 24 by the fan 82, thereby cooling the air. Lubricant circulates through the lubricant flow path 16 to cool, and provide lubrication to, the components of the compressor, including the scroll members 46, 48 and the crankshaft 50, for example. Coolant circulates through the coolant flow path 18 to cool and transfer heat from the refrigerant and lubricant in the refrigerant flow path 14 and the lubricant flow path 16, respectively.

It will be appreciated that the climate control system 10 can also function as a heat pump system operable in a heating mode, by forcing the heat transferred by the condenser 20, the second condenser 22, and the lubricant heat exchanger 26 into a space to be heated by the system 10.

During operation of the climate control system 10, the refrigerant exiting the discharge port 38 may be at a higher temperature than the lubricant exiting the outlet port 43, while the refrigerant exiting the condenser 20 and/or entering the second condenser 22 may be at a lower temperature than the lubricant exiting the outlet port 43. Accordingly, coolant may exit the second condenser 22 at a temperature T2 after heat is transferred to the coolant from the refrigerant. The coolant may then enter the lubricant heat exchanger 26 and exit the lubricant heat exchanger at a temperature T4 (greater than T2), after heat is transferred to the coolant flow path 18 from the lubricant flow path 16. The coolant may then enter the condenser 20 and exit the condenser 20 at a temperature T1 (greater than T2 and T4).

As the coolant flows through the coolant flow path 18 from the second condenser 22 to the lubricant heat exchanger 26 and to the condenser 20, the temperature of the coolant may increase from T2 to T4 and from T4 to T1. More specifically, coolant downstream of the lubricant heat exchanger 26 may be at a higher temperature than coolant downstream of the second condenser 22. Likewise, coolant downstream of the condenser 20 may be at a higher temperature than coolant downstream of the lubricant heat exchanger 26. The heat in the coolant that exits the condenser 20 at temperature T1 may be recaptured in various ways and utilized by various devices or in various systems.

The climate control system 10 described above operates at an improved level of efficiency, with an improved coefficient of performance (i.e., units of heat transferred by the system for every unit of power consumed by the system) as the coolant and the coolant flow path 18 are able to capture and absorb the heat that is stored in both the refrigerant and the lubricant. In addition, the utilization of both the condenser 20 and the second condenser 22 ensures improved cooling of the refrigerant as it flows through the refrigerant flow path 14, and thus further improves the efficiency of the climate control system 10.

Figure 1C:
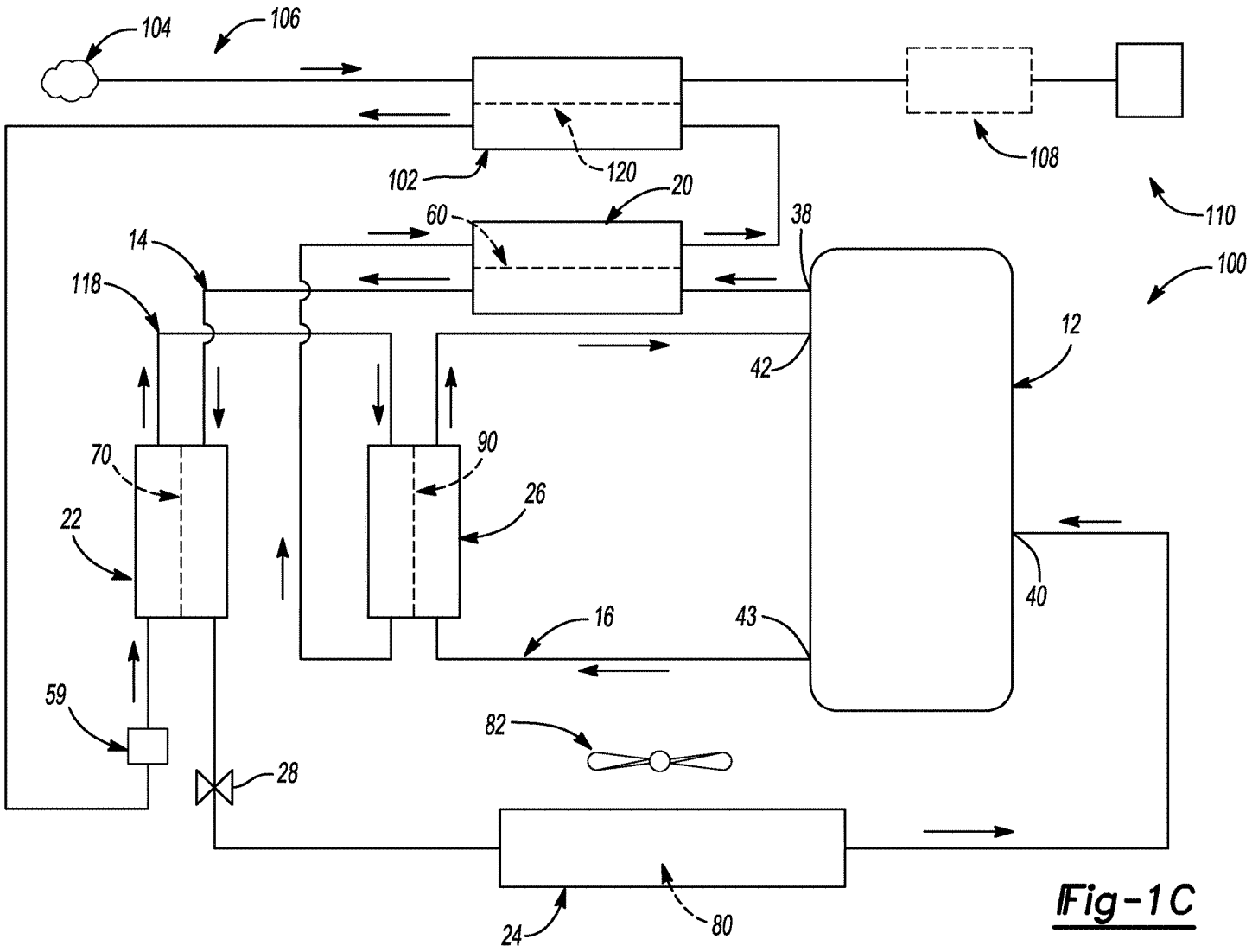
FIG. 1C is a schematic representation of yet another heat pump system incorporating a water heating system in accordance with the principles of the present disclosure.

With reference to FIG. 1C, another configuration of a climate control system 100 is illustrated. The climate control system 100 may be substantially similar to the climate control system 10, except as otherwise provided herein. Accordingly, like reference numerals will be used to describe similar features. The climate control system 100 may include a fifth heat exchanger 102, a fluid (e.g., water) source 104, a fluid flow path 106, an optional or auxiliary sixth heat exchanger 108, and a fluid reservoir 110. The fifth heat exchanger 102 may be a shell and tube heat exchanger, a plate heat exchanger, or any other suitable heat exchanger construct.

A coolant flow path 118 may allow for fluid communication between the fifth heat exchanger 102, the condenser 20, the second condenser 22, and the lubricant heat exchanger 26. Accordingly, the coolant flow path 118 may form a closed circuit or loop. Coolant, such as water, may be pumped through the coolant flow path 118 via the pump 59.

The fluid flow path 106 may allow for fluid communication between the fluid source 104, the fifth heat exchanger 102, the sixth heat exchanger 108, and the fluid reservoir 110. The fluid source 104 may be a well, a municipal water supply, or other suitable water source. The sixth heat exchanger 108 may allow for the exchange of heat from an auxiliary heat source (e.g., solar heat, electrical heat, gas heat, etc.) to the fluid flow path 106. The fluid reservoir 110 may be a tank such as a hot water heating tank suitable for supplying potable water.

During operation of the climate control system 100, coolant in the coolant flow path 118 may flow into the fifth heat exchanger 102 from the condenser 20 in the second direction counterflow to the first direction. Heat may be transferred from the coolant through a coil 120 and absorbed by the fluid in the fluid flow path 106. The coolant, upon undergoing a temperature reduction in the fifth heat exchanger 102, may flow into the second condenser 22 from the fifth heat exchanger 102 to begin the heat exchange cycle described herein with respect to the climate control system 10. The fluid, upon undergoing a temperature increase in the fifth heat exchanger 102, may flow into the sixth heat exchanger 108 from the fifth heat exchanger 102, where additional heat may be transferred to the fluid from the auxiliary heat source. Upon exiting the sixth heat exchanger 108, the fluid may flow into the fluid reservoir 110 for storage and/or for additional heat exchange prior to use (e.g., domestic hot water source).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate control system comprising:

a compressor having a suction port, a first discharge port and a second discharge port;

a first heat exchanger in fluid communication with said first discharge port;

a second heat exchanger in fluid communication with said second discharge port;

a third heat exchanger in fluid communication with said first heat exchanger;

a fourth heat exchanger in fluid communication with said third heat exchanger and said suction port; and a coolant flow path separate form a flow path connecting said first heat exchanger, said third heat exchanger, and said fourth heat exchanger and connecting said first heat exchanger, said second heat exchanger, and said third heat exchanger in fluid communication.

2. The climate control system of claim 1, wherein said second heat exchanger is a lubricant heat exchanger.

3. The climate control system of claim 1, wherein a first fluid exiting the first discharge port is at a higher temperature than a second fluid exiting the second discharge port.

4. The climate control system of claim 1, wherein said first heat exchanger is a condenser and said fourth heat exchanger is an evaporator.

5. The climate control system of claim 1, wherein said first heat exchanger is a gas cooler and said fourth heat exchanger is an evaporator.

6. The climate control system of claim 1, wherein coolant downstream of said second heat exchanger is at a higher temperature than coolant downstream of said third heat exchanger.

7. The climate control system of claim 1, wherein said compressor further comprises an inlet port in fluid communication with said second discharge port.

8. The climate control system of claim 7, wherein said inlet port is a lubricant entry port and said second discharge port is a lubricant discharge port.

9. The climate control system of claim 1, wherein coolant downstream of said first heat exchanger is at a higher temperature than coolant downstream of said second heat exchanger.

10. A climate control system comprising:

a first fluid flow path fluidly coupled to a first heat exchanger, a second heat exchanger and a third heat exchanger;

a second fluid flow path fluidly coupled to a fourth heat exchanger; and a third fluid flow path fluidly coupled to said first heat exchanger, said second heat exchanger and said fourth heat exchanger, wherein said first fluid flow path includes an expansion valve disposed between said second heat exchanger and said third heat exchanger.

11. The climate control system of claim 10, further comprising a compressor, wherein said second fluid flow path is a lubricant flow path in fluid communication with said compressor.

12. The climate control system of claim 10, further comprising a compressor, wherein said first fluid flow path is a refrigerant flow path in fluid communication with said compressor.

13. The climate control system of claim 10, wherein said second heat exchanger is a condenser and said third heat exchanger is an evaporator.

14. A climate control system comprising:

a compressor having a suction port, a first discharge port and a second discharge port;

a first heat exchanger in fluid communication with said first discharge port;

a second heat exchanger;

a third heat exchanger in fluid communication with said second heat exchanger and said suction port;

a fourth heat exchanger in fluid communication with said second discharge port;

a coolant flow path separate from a flow path connecting said first heat exchanger, said second heat exchanger, and said third heat exchanger and including said first heat exchanger, said second heat exchanger and said fourth heat exchanger; and a fluid flow path including a fluid source, a fifth heat exchanger, and a fluid reservoir, wherein a fluid flows from said fluid source to said fifth heat exchanger and from said fifth heat exchanger to said fluid reservoir.

15. The climate control system of claim 14, wherein said fifth heat exchanger is in fluid communication with said first heat exchanger, said second heat exchanger, and said fourth heat exchanger.

16. The climate control system of claim 14, wherein said fluid reservoir is a hot water tank.

17. The climate control system of claim 16, further comprising an auxiliary heat exchanger in fluid communication with said fifth heat exchanger and said hot water tank.

* * * * *